United States Patent [19]

Mikolajczyk

[11] 4,416,547

[45] Nov. 22, 1983

[54] PORTABLE PROPORTIONING DEVICE

[76] Inventor: Raymond F. Mikolajczyk, Rte. 1, Box 57-A, Broussard, La. 70518

[21] Appl. No.: 343,443

[22] Filed: Jan. 28, 1982

[51] Int. Cl.[3] ..... B01F 15/02

[52] U.S. Cl. ..... 366/150; 222/415

[58] Field of Search ..... 366/162, 30, 33, 34, 366/36, 41, 42, 49, 154, 160, 181, 182, 193, 150; 222/415, 55

[56] References Cited

U.S. PATENT DOCUMENTS

| | | | |
|---|---|---|---|
| 3,128,997 | 4/1964 | Young | 366/30 |
| 3,917,236 | 11/1975 | Hanson | 366/49 |
| 4,007,921 | 2/1977 | Zingg | 366/30 |
| 4,100,614 | 7/1978 | Mandt | 366/154 |
| 4,210,166 | 7/1980 | Munie | 366/160 |
| 4,285,599 | 8/1981 | Zitser | 366/34 |

*Primary Examiner*—Robert W. Jenkins
*Attorney, Agent, or Firm*—Jack W. Hayden

[57] ABSTRACT

Support means support an upright hopper means and mixing hopper means. Continuous conveyor means extend from adjacent the lower end of the upright hopper means to adjacent the upper end of the mixing hopper means. Motor means move the conveyor means to carry dry bulk material from the upright hopper means to the mixing hopper means, and control means control the amount of material on the conveyor means as it leaves the upright hopper means.

Discharge valve means adjacent the lower end of the valve hopper means communicate with liquid conducting means which is provided with an orifice therein which assists in discharging material from the mixing hopper means into the liquid conducting conduit means.

1 Claim, 2 Drawing Figures fig.1
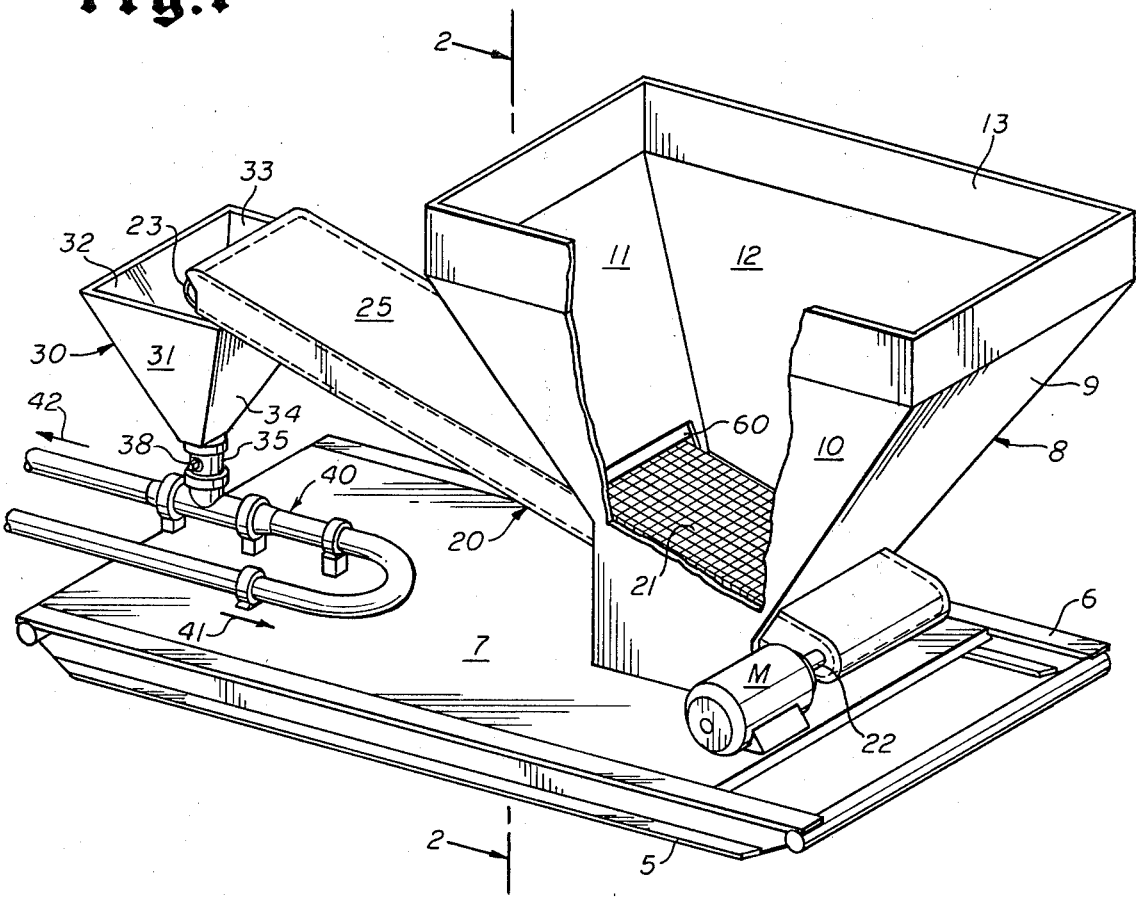
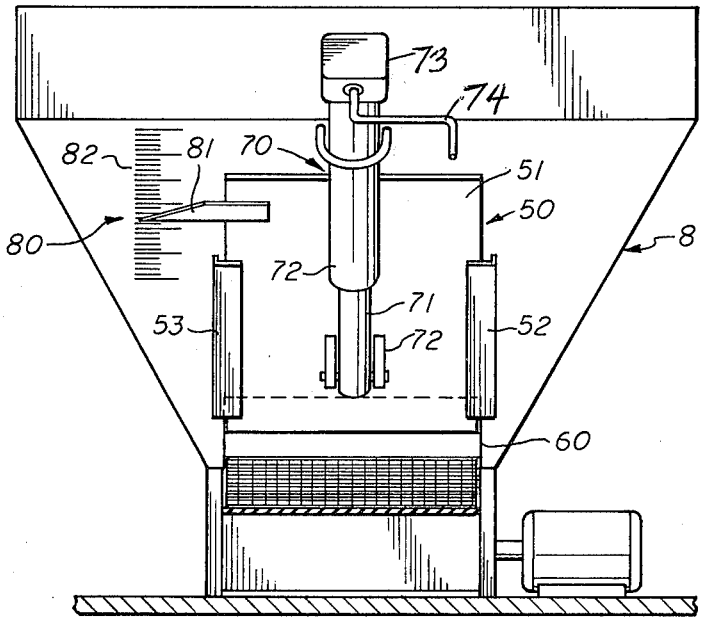
fig.2

PORTABLE PROPORTIONING DEVICE

SUMMARY OF THE INVENTION

During the drilling of a gas or oil well, it is necessary to use drilling fluids. These drilling fluids are used to carry formation cuttings out of the well bore, keep the drill bit cool, wall cake the sides of the well bore and retain formation pressures and elements. This drilling fluid must be able to remain in a stable condition while being circulated through adverse hole conditions, high temperatures and pressures. For the drilling fluid to remain stable, dry chemicals must be added at a prescribed rate to maintain a homogeneous drilling fluid system. Some drilling fluid systems may be 1000–2000 bbls with most of the volume in the hole and the rest in tanks on the surface. To circulate around may require three to six hours. That is, the mud going in now may take three to six hours of pumping before it gets back to the pump. To properly blend the chemicals, it is necessary to continuously mix at the same rate for this circulating time.

The present invention provides a portable arrangement which can be transported from well location to well location and connected for mixing desirous dry chemicals into the drilling fluid system at a prescribed rate.

An object of the present invention is to provide a transportable proportioning device to mix desired quantities of dry drilling fluid chemicals for discharge to a drilling fluid system as may be needed.

Other objects and advantages of the present invention will become apparent from a consideration of the following description and drawings.

BRIEF DESCRIPTION OF THE DRAWINGS

FIG. 1 is a perspective view illustrating the preferred embodiment of the present invention; and FIG. 2 is an end view of the device on the line 2—2 of FIG. 1 illustrating further details of the present invention.

DESCRIPTION OF THE PREFERRED EMBODIMENTS

Attention is first directed to FIG. 1 of the drawings wherein support means are illustrated by the letter S. The support means is illustrated as being in the form of skid means 5 and 6 carrying suitable plate means 7 therebetween for supporting the upright bulk hopper means represented at 8. The upright bulk hopper means is of any suitable configuration and as illustrated includes four walls 9, 10, 11 and 12 which slope downwardly from their upper end as illustrated in FIG. 1 of the drawings whereby dry bulk material dumped into the open upper end 13 of the upright hopper means will tend to be fed down the sloping side walls 9, 10, 11 and 12 towards the continuous conveyor means represented at 20. The continuous conveyor means is formed by a continuous conveyor belt 21 which is rotatably mounted on the shafts 22 and 23 and the shaft 22 is connected with the motor means M to impart rotation to the continuous conveyor bolt 21.

It is to be noted that the width of the continuous conveyor belt is substantially the width formed by the space where such conveyor belt passes through the bottom of the upright hopper means 13 adjacent the lower end of the downwardly and inwardly sloping sides 9, 10, 11 and 12 of the upright hopper means 8.

It will be noted that the conveyor means 20 is covered or provided with housing means 25 which extend between the upright hopper means 8 and the mixing hopper means referred to generally by the numeral 30. The mixing hopper means 30 is also formed by side walls 31, 32, 33 and 34 which slope downwardly and inwardly from their upper ends as illustrated in the drawings and are connected at their lower ends to the discharge means 35. The discharge means 35 is provided with valve means, (not shown) which valve means may be of any suitable form and can be opened or closed by manipulating the shaft 38 extending outwardly of the discharge means 35 for opening or closing the discharge means 35. The discharge means 35 communicates at its upper end as illustrated in the drawings with the mixing hopper 30 and at its lower end with the fluid or liquid conducting conduit means referred to generally by the numeral 40. The liquid conducting conduit means is connected with a source of liquid which flows therethrough in the direction represented by the arrow 41. Suitable orifice means of any desired configuration and well known to those skilled in the art (not shown) is arranged in the liquid conducting conduit means 40 to create a pressure drop adjacent the intersection of the discharge means 35 with the liquid conduit 40 to assist in sucking or aiding the discharge of dryable material from the mixing means 30 to the liquid conducting conduit means 40. This enables the bulk material to be sucked or moved into the liquid conduit means 40 and then discharged as represented by the arrow 42 to a suitable liquid storage means for subsequent discharge into a well bore or the like.

In order to regulate the amount of material leaving the upright hopper means, suitable control means as represented generally at 50 in FIG. 2 are provided. Such control means includes plate means 51 slidably received in the supports 52 and 53 as illustrated in FIG. 2. The plate means regulates the amount of opening 60 in the upright hopper means 8 as illustrated in FIGS. 1 and 2 and thereby regulates the amount of material that can be conducted from the upright bulk hopper means 8 to the mixing hopper means 30.

One form of control 50 which regulates the amount of opening 60 in the lower end of the upright hopper means 8 is referred to generally by the numeral 70 in FIG. 2. Such control means or mechanism includes the shaft 71 which is pivotally connected as illustrated at 72 at its lower end to the plate means 51. The shaft means 71 extends upwardly through the housing 72, and its upper end terminates in the housing 73, which housing supports a suitable gear arrangement to impart up or down movement to shaft 72 when crank lever 74 is rotated.

Rotation of the crank lever 74 causes the gear means in housing 73 to rotate and effect raising or lowering of the shaft means 71. This in turn raises and lowers plate means 51 to open or close opening means 60 in the lower end of upright bulk hopper means 8.

Indicating means as illustrated at 80 are provided so that the opening 60 can be calibrated initially if desired, and thereafter the position of the plate means 50 as determined by the indicator 81 on the scale 82 will determine the amount of material permitted to be carried from upright hopper means 8 to mixing hopper means 30 by the conveyor belt 21.

The opening 60 may be set at a desired position, and the amount of material carried from hopper 8 to hopper 30 may be regulated by the speed of the conveyor belt 21. This can be accomplished by employing a variable speed motor M, and by changing the speed of the motor, the rate of transfer of material from hopper 8 to hopper 30 is changed, thus changing the volume of material transferred.

As previously noted, the conveyor belt 21 extends throughout the length and substantially throughout the width of the lower end of the upright hopper means 8 and in effect forms the bottom surface therein. The movement thereof is determined by the motor means M which is powered by any suitable electric or hydraulic source (not shown).

In operation of the present invention, it is moved onto location and the liquid conducting conduit means 40 is connected with a source of liquid and with a source of storage as represented by the arrows 41, 42, respectively. The motor means M is started, and this causes the belt 21 to move between the upright hopper means 8 and the mixing hopper means 30 at a regulated speed. Dry bulk material of various types is dumped into the upper open end 13 of the upright bulk hopper means 8 and movement of the conveyor belt means 21 conveys such dry bulk material to the mixing hopper means 30. The opening 60 is regulated to add the desired amount of dry bulk material to the mixing hopper means 30 over a predetermined period of time, and the discharge means 35 is opened so that as liquid passes beneath such discharge means, the orifice arranged in the liquid conducting conduit means assists in sucking or drawing the dry bulk material into the liquid conducting conduit means 40 to be conveyed with the liquid in the liquid conducting conduit means 40 to storage for subsequent discharge to the well bore or to the well drilling apparatus for discharge therein. The foregoing disclosure and description of the invention are illustrative and explanatory thereof, and various changes in the size, shape and materials as well as in the details of the illustrated construction may be made without departing from the spirit of the invention.

What is claimed is:

1. A rotary drilling fluid mixing arrangement including:

a. support means;

b. upright hopper means for receiving dry bulk material carried by said support means;

c. mixing hopper means carried by said support means and spaced laterally from said hopper means;

d. continuous conveyor means extending from adjacent the lower end of said upright hopper means to adjacent the upper end of said mixing hopper means, said conveyor means extending throughout the width of said upright hopper means to form the bottom surface therein;

e. means to move said conveyor means and carry dry bulk material from said upright hopper means to said mixing hopper means;

f. control means to control the amount of material on said conveyor means as it moves from said upright hopper means, said control means including:

1. an opening in a wall of said upright hopper means through which said continuous conveyor means extends; and 2. regulating means to regulate the size of the opening and thereby control the amount of bulk material which may be carried on the conveyor means from said upright hopper means to said mixing hopper means, said regulating means comprising;

(a) movable plate means;

(b) means to support said movable plate means on said upright hopper means adjacent the opening in the wall thereof; and (c) means to raise and lower said movable plate means;

g. discharge means adjacent the lower end of said mixing hopper means;

h. liquid conducting conduit means connected to receive material from said discharge means; and i. means to regulate the amount of dry bulk material transferred by said conveyor means from said upright hopper means to said mixing hopper means, said means including a variable speed motor to move said conveyor means.

* * * * *